US005221930A

United States Patent [19]

Scott

[11] Patent Number: 5,221,930

[45] Date of Patent: Jun. 22, 1993

[54] ADJUSTABLE DIPOLE ANTENNA

[75] Inventor: Kenneth R. Scott, Lawrence, Kans.

[73] Assignee: AlliedSignal Inc., Morris Township, Morris County, N.J.

[21] Appl. No.: 804,278

[22] Filed: Dec. 6, 1991

[51] Int. Cl.[5] ..... H01Q 1/08; H01Q 9/16

[52] U.S. Cl. ..... 343/823; 343/877

[58] Field of Search ..... 343/823, 877

[56] References Cited

U.S. PATENT DOCUMENTS

| | | | |
|---|---|---|---|
| 1,911,234 | 5/1933 | Meyer | 343/823 |
| 2,462,229 | 2/1949 | Shur | 343/823 |
| 2,537,481 | 1/1951 | Parsons | 343/823 |
| 2,540,696 | 2/1951 | Smith | 343/823 |
| 4,663,632 | 5/1987 | Budrow et al. | 343/714 |

FOREIGN PATENT DOCUMENTS

| | | | |
|---|---|---|---|
| 1171169 | 1/1959 | France | 343/823 |
| 521052 | 3/1955 | Italy | 343/823 |

*Primary Examiner*—Michael C. Wimer

*Attorney, Agent, or Firm*—Donald B. Paschburg; Howard G. Massung

[57] ABSTRACT

A drum is used to wind and unwind conductors that comprise the elements of an adjustable dipole antenna. The length of the elements is adjusted by rotating the drum. As the elements are unwound, they extend into tubular TEFLON guides that provide support for the elements.

4 Claims, 2 Drawing Sheets

ADJUSTABLE DIPOLE ANTENNA

BACKGROUND OF THE INVENTION

1. Field of the Invention

The present invention relates to dipole antennas, more specifically it relates to adjustable dipole antennas.

2. Description of the Related Art

In the past, adjustable dipole antennas were fabricated using telescoping antenna elements that extended in opposite directions. The antennas were adjusted to a specific frequency by adjusting the lengths of the telescoping antenna elements. Using adjustable dipole antennas that comprised telescoping antenna elements have several draw backs. When the antenna is adjusted to receive low frequency signals, the antenna elements must be extended to relatively long lengths. Due to the weight of a telescoping element structure, the ends of the antenna elements tended to droop when extended out for low frequency operation. This drooping adversely effected the antenna's performance. In addition, long antenna elements adversely effected antenna performance by swaying in the wind.

An antenna element using a telescoping construction can only be adjusted over a limited range. For example, the antenna cannot be adjusted to a length which is shorter than the first section of the telescoping structure. This limitation requires using a variety of telescoping elements when the adjustable dipole antenna is intended for use over a wide range of frequencies.

SUMMARY OF THE INVENTION

The present invention comprises an adjustable dipole antenna with a wound conductor. A rotating drum means winds and unwinds the wound conductor, and a tubular guide means receives the wound conductor as the wound conductor is unwound from the rotating drum means.

The tubular guides of the present invention can be made stiff or can be supported at the distal ends by a vertical support. By using stiff tubular guides or distal vertical supports, the present invention does not suffer from drooping or swaying as does the telescoping adjustable dipole antennas. In addition, the antenna elements of the present invention are wound on a spool or drum and thereby provide infinite adjustability and do not require changing elements when operating the dipole antenna over a wide frequency range.

DESCRIPTION OF THE PREFERRED EMBODIMENTS

Figure 1:
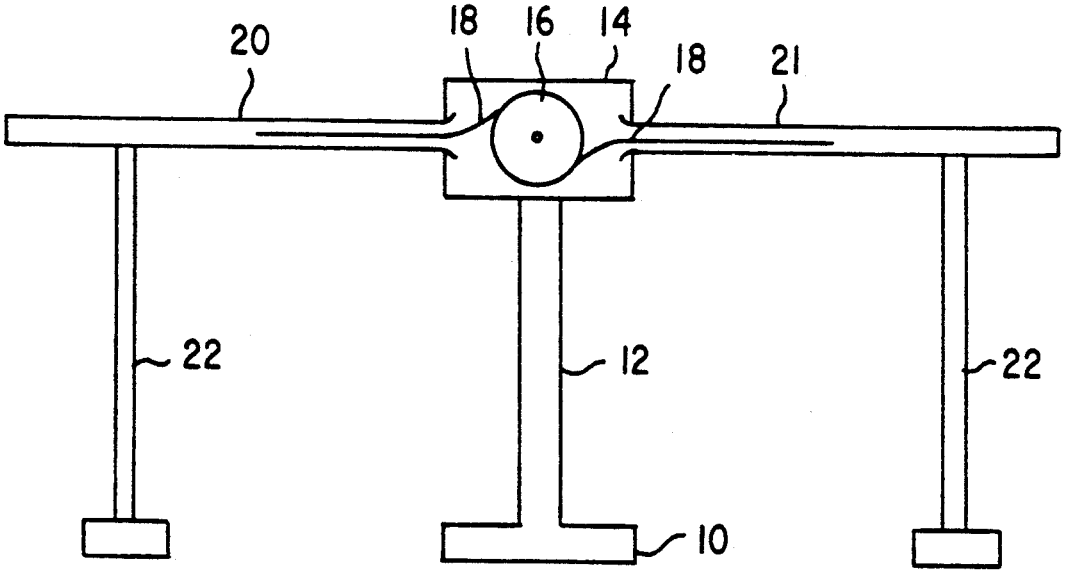
FIG. 1 illustrates a cross section of the present invention taken along a vertical plane.

FIG. 1 illustrates a vertical cross section of the present invention. Base 10 supports vertical member 12. On the upper end of vertical member 12 is housing 14. Housing 14 contains drum or spool 16 that is used to wind and unwind conductors 18 that act as the elements of the adjustable dipole antenna. Conductors 18 extend into tubular guides 20 and 21 when they are unwound from drum 16, and conductors 18 are withdrawn from tubular guides 20 and 21 when they are wound on drum 16. Tubular guides 20 and 21 should be transparent to RF energy and should be weather resistant. It is preferable to construct tubular guides 20 and 21 out of a material that is stiff and will not droop or sway in the wind. It is also possible to use vertical supports 22 at the distal ends of tubular guides 20 and 21. Vertical supports 22 can be used to prevent tubular guides 20 and 21 from drooping or swaying in the wind.

Figure 2:
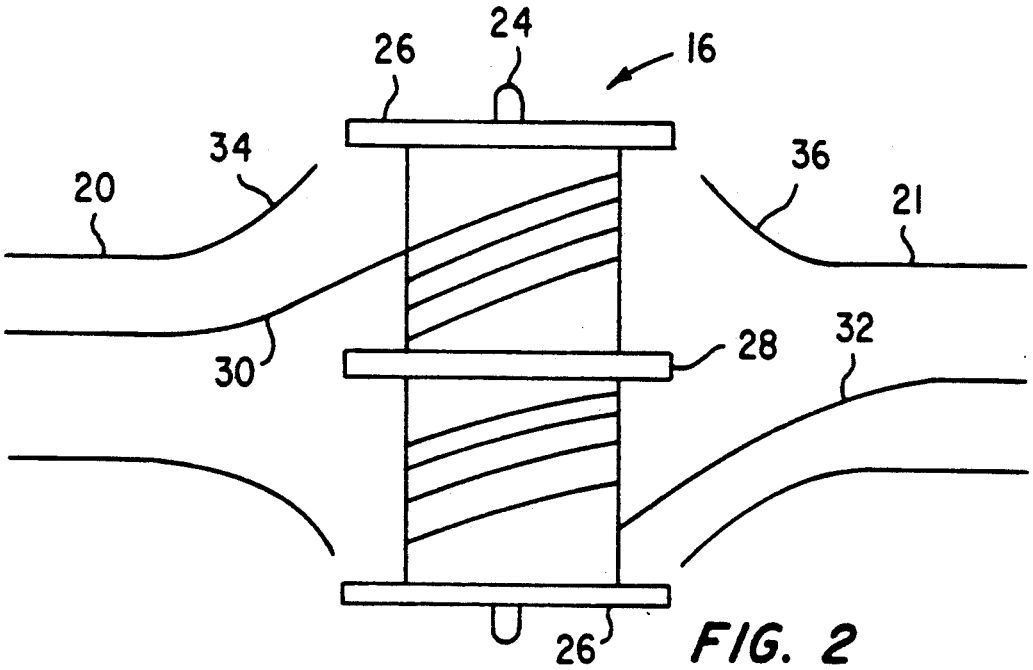
FIG. 2 illustrates the spool or drum and the tubular guides.

FIG. 2 illustrates drum 16 and the proximal ends of tubular guides 20 and 21. Drum or spool 16 rotates about axis 24. Guides 26 are located at each end of drum 16. Guides 26 prevent conductor 18 from slipping off drum 16 when being wound onto drum 16. Insulator 28 is centrally located between guides 26. Insulator 28 prevents the elements of the dipole from short circuiting. It is preferable that the surface of the drum which is located between guide 26 and insulator 28 have a conductive coating. This conductive coating facilitates short circuiting the portion of an antenna element that is wound around the drum. Conductors 18 comprises left conductor or element 30 and right conductor or element 32. Left element 30 and right element 32 are wound around drum 16 in the same direction. By winding elements 30 and 32 in the same direction, the elements of the dipole can be simultaneously wound by rotating drum 16 in one direction and they can be simultaneously unwound by rotating drum 16 in the opposite direction. As antenna elements 30 and 32 are unwound, they extend into the proximal ends of tubular guides 20 and 21, respectively. Proximal ends 34 and 36 of tubular guides 20 and 21 respectively, are flared to facilitate guiding elements 30 and 32 into the guides as they are unwound from drum 16. To further facilitate guiding antenna elements 30 and 32 into tubular guides 20 and 21, it is preferable to manufacture the tubular guides using a material such as TEFLON. Elements 30 and 32 can be made using any conductive material, but it is preferable to use a material that has sufficient stiffness to enable it to extend into the tubular guides without jamming, however, the conductor should not be so stiff that it cannot be wound on drum 16. It is preferable to use a conductor such as beryllium copper. Drum 16 can be rotated manually or by an electrically driven actuator. The electrically driven actuator can be controlled by switches or it can be controlled automatically by devices such as microcomputers, microprocessors, or computers.

Figure 3:
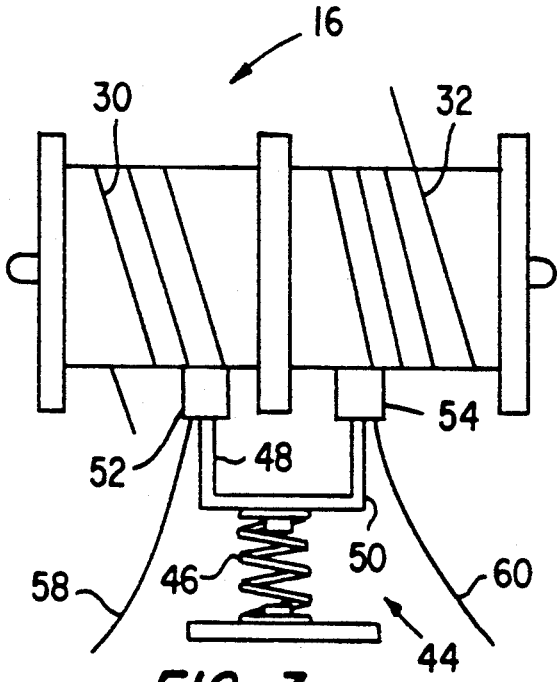
FIG. 3 illustrates the spool or drum and a spring loaded contact.

FIG. 3 illustrates drum 16 and spring loaded contact assembly 44. Contact assembly 44 is held in position by spring 46. Ends 48 and 50 of contact assembly 44 support brush contacts 52 and 54, respectively. Brush contacts 52 and 54 make electrical contact with elements 30 and 32, respectively. The brush contacts are kept in electrical contact by the force exerted by spring 46. Conductors 58 and 60 are connected to brush contacts 52 and 54, respectively. Conductors 58 and 60 feed the signal received by the dipole elements to a receiver or transformer. It is preferable to choose conductors 58 and 60 in a manner which avoids an impedance mismatch between the conductor and dipole element.

Figure 4:
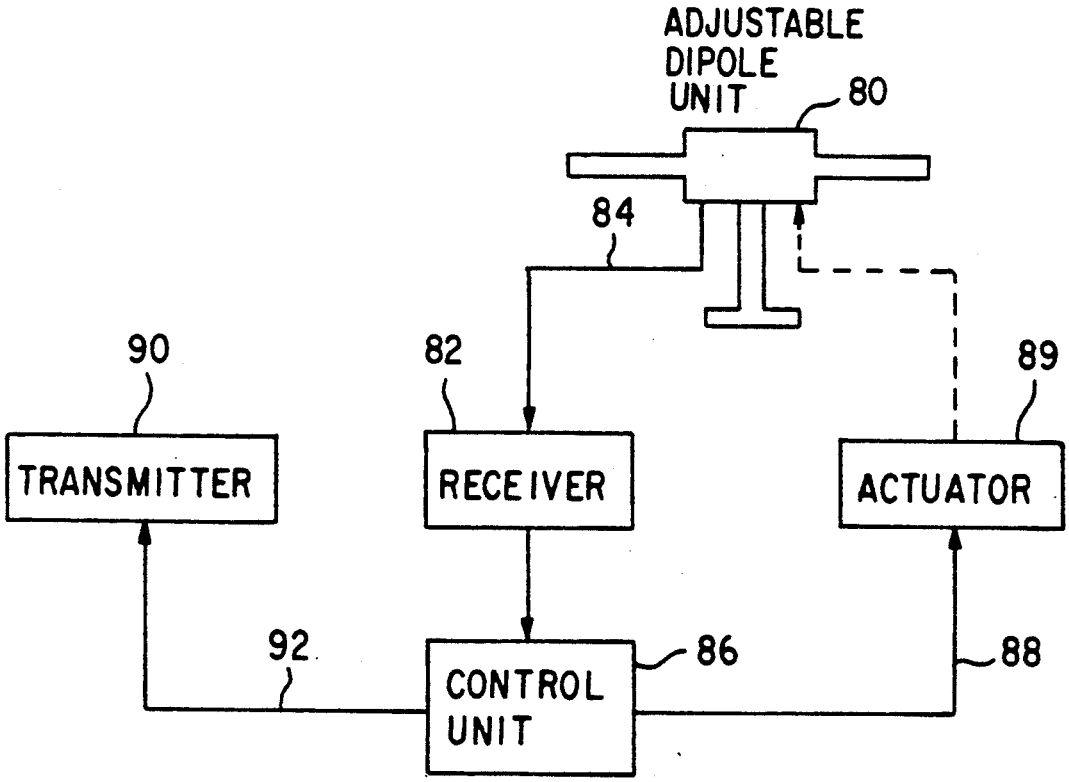
FIG. 4 is a block diagram that illustrates a method for automatically controlling the length of the antenna elements of the present invention.

FIG. 4 is a block diagram that illustrates a method and apparatus for automatically adjusting the length of the dipole elements. Adjustable dipole assembly 80 is connected to receiver 82 by conductors 84. Conductors 84 feed the RF signal received by the dipole elements to receiver 82. Adjustable dipole assembly 80 is also connected to control unit 86 by conductor 88. Control 86 uses conductor 88 to control an electrically driven actuator 89 that rotates drum 16 to adjust the length of the dipole elements. Control unit 86 is also connected to transmitter unit 90 by conductor 92. Control unit 86 uses conductor 92 to control the frequency transmitted by unit 90. Control unit 86 can be a microprocessor, microcomputer or a personal computer.

The length of the dipole elements is automatically adjusted to a selected frequency using control unit 86. Control unit 86 instructs transmitter 90 to transmit the desired frequency. Adjustable dipole unit 80 receives the transmitted signal and feeds that signal to receiver 82. Receiver 82 provides control unit 86 with information that indicates the amplitude of the signal received by dipole assembly 80. Control unit 86 then activates the actuator in adjustable dipole antenna assembly 80 to control the length of dipole elements or conductors 30 and 32. Control unit 86 either winds or unwinds the antenna elements to maximize the amplitude of the signal received by receiver 82. When a maximum signal is obtained, the adjustment is complete.

I claim:

1. An adjustable dipole antenna, comprising:

a base;

a vertical member supported by the base:

a housing supported on the upper end of the vertical member;

a drum disposed within the housing;

first and second electrical conductors disposed on the drum and extending therefrom in opposing relationship;

means for rotating the drum in one direction and in an opposite direction, whereby the first and second conductors are simultaneously wound on said drum in the same direction and are unwound therefrom in the same direction;

first and second guide means extending substantially horizontally and in opposing relationship from the housing, with said first and second conductors extending into the first and second guide means, respectively, when the first and second conductors are unwound from the drum, and moving outwardly from the respective guide means when wound on said drum;

means supporting the guide means for preventing drooping and swaying of the first and second guide means under wind conditions and the proximal ends of the first and second guide means are flared to facilitate receipt thereby of the first and second electrical conductors, respectively.

2. An adjustable dipole antenna as described by claim 1, including:

the drum having first and second conductive surfaces separated by an insulator; and means arranged with the first and second conductive surfaces and the first and second electrical conductors for maintaining electrical contact between said drum and said electrical conductors.

3. An adjustable dipole antenna as described by claim 1, wherein the means for preventing drooping and swaying of the first and second guide means under wind conditions includes:

first and second substantially vertically extending support members for supporting the distal ends of the first and second guide means, respectively.

4. An adjustable dipole antenna, comprising:

a base;

a vertical member supported by the base;

a housing supported on the upper end of the vertical member;

a drum disposed within the housing;

first and second electrical conductors disposed on the drum and extending therefrom in opposing relationship;

means for rotating the drum in one direction and in an opposite direction, whereby the first and second conductors are simultaneously wound on said drum in the same direction and are unwound therefrom in the same direction;

first and second guide means extending substantially horizontally and in opposing relationship from the housing, with said first and second conductors extending into the first and second guide means, respectively, when the first and second conductors are unwound from the drum, and moving outwardly from the respective guide means when wound on said drum;

means supporting the guide means for preventing drooping and swaying of the first and second guide means under wind conditions;

the proximal ends of the first and second guide means are flared to facilitate receipt thereby of the first and second electrical conductors, respectively;

control means connected to a transmitter for commanding said transmitter to transmit a signal at a desired frequency;

the adjustable dipole antenna receiving the transmitted signal;

receiver means connected to the adjustable dipole antenna and to the control means and responsive to the transmitted signal received by the antenna for applying a signal corresponding to the amplitude of the signal received by the antenna to the control means; and the means for rotating the drum connected to the control means and coupled to the drum, and controlled by the control means for rotating the drum, whereby the length of the conductors moving outwardly from the drum is adjusted commensurate with a maximum amplitude of the signal received by the antenna.

* * * * *